US007520791B2

(12) United States Patent
Kawase

(10) Patent No.: US 7,520,791 B2
(45) Date of Patent: Apr. 21, 2009

(54) METHOD OF MANUFACTURING AIRTIGHT VESSEL FOR IMAGE DISPLAYING APPARATUS

(75) Inventor: Toshimitsu Kawase, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 564 days.

(21) Appl. No.: 11/020,102

(22) Filed: Dec. 27, 2004

(65) Prior Publication Data

US 2005/0156505 A1 Jul. 21, 2005

(30) Foreign Application Priority Data

Jan. 21, 2004 (JP) ..... 2004-012993
Dec. 15, 2004 (JP) ..... 2004-362525

(51) Int. Cl.
*H01J 9/26* (2006.01)
*H01J 9/24* (2006.01)
*H01J 1/62* (2006.01)

(52) U.S. Cl. ..... 445/25; 445/24; 313/495

(58) Field of Classification Search ..... 313/495–497; 445/24–25
See application file for complete search history.

(56) References Cited

U.S. PATENT DOCUMENTS

| | | | | |
|---|---|---|---|---|
| 5,813,893 | A | 9/1998 | Robinson | 445/25 |
| 6,169,356 | B1 | 1/2001 | Ohnishi et al. | 313/495 |
| 6,254,449 | B1 | 7/2001 | Nakanishi et al. | 445/25 |
| 6,344,711 | B1 | 2/2002 | Ohnishi et al. | 313/495 |
| 6,384,541 | B1 | 5/2002 | Ohnishi et al. | 315/169.3 |
| 6,506,089 | B2 | 1/2003 | Nakanishi et al. | 445/25 |
| 6,722,937 | B1 * | 4/2004 | Ludwig et al. | 445/25 |
| 6,885,156 | B2 | 4/2005 | Tajima et al. | 315/169.3 |
| 2001/0009836 | A1 | 7/2001 | Nakanishi et al. | 445/66 |
| 2003/0071562 | A1 | 4/2003 | Ando | |
| 2003/0122472 | A1 | 7/2003 | Kawase | 313/422 |
| 2005/0046332 | A1 | 3/2005 | Tajima et al. | 313/495 |
| 2006/0087224 | A1 * | 4/2006 | Oki et al. | 313/504 |

FOREIGN PATENT DOCUMENTS

| | | |
|---|---|---|
| EP | 1389792 A1 | 2/2004 |
| EP | 1589554 A1 | 10/2005 |
| JP | 62-168555 | 7/1987 |
| JP | 4-334844 | 11/1992 |
| JP | 7-235255 | 9/1995 |

(Continued)

OTHER PUBLICATIONS

Chinese Notification of First Office Action dated Apr. 25, 2008, regarding Application No. 200510004389.8.

*Primary Examiner*—Nimeshkumar D. Patel
*Assistant Examiner*—Anne M Hines
(74) *Attorney, Agent, or Firm*—Fitzpatrick, Cella, Harper & Scinto

(57) ABSTRACT

The present application discloses a method of manufacturing airtight vessel. More specifically, here is disclosed a method of manufacturing airtight vessel having two substrates, and a frame portion fixed to the two substrates and forming a prescribed space between the two substrates, the method comprising a step of keeping a frame member for the frame portion in a prescribed shape by applying a tension to at least a part of the frame member for the frame portion, and a step of adhering the frame member to at least one of the substrates in a state in which the prescribed shape is kept.

8 Claims, 10 Drawing Sheets

FOREIGN PATENT DOCUMENTS

| | | | | |
|---|---|---|---|---|
| JP | 11-135018 | | | 5/1999 |
| JP | 2000-323073 | | | 11/2000 |
| JP | 2000-323075 | | | 11/2000 |
| JP | 2002-343828 | | | 11/2002 |
| JP | 2002373580 | | | 12/2002 |
| JP | 2002373581 | | | 12/2002 |
| JP | WO 03092332 | A | * | 11/2003 |
| JP | 2005-63854 | | | 3/2005 |
| WO | 0208169 | A2 | | 1/2002 |

* cited by examiner

METHOD OF MANUFACTURING AIRTIGHT VESSEL FOR IMAGE DISPLAYING APPARATUS

BACKGROUND OF THE INVENTION

1. Field of the Invention

The present invention relates to a method of manufacturing airtight vessel whose inside is to be kept airtight, and more particularly to a method of manufacturing airtight vessel which can be suitably applied to display panels of image displaying apparatus. The invention also relates to an image displaying apparatus, and a method of manufacturing image displaying apparatus. It also relates to a method of manufacturing television sets.

2. Related Background Art

Usually, an image displaying apparatus utilizing electron emission requires an envelope for maintaining a vacuum ambience, an electron source provided with a plurality of electron-emitting devices and a drive circuit therefor, an image-forming member having a phosphor or the like which is caused to emit light by the collision of electrons, and accelerating electrodes for accelerating the motions of electrons towards the image-forming member and a voltage source or the like therefor. An image displaying apparatus using a flat envelope, such as a thin image displaying apparatus or the like, may use supports (spacers) as structures to endure the atmospheric pressure.

Two types of the electron-emitting devices are already known, including hot cathode devices and cold cathode devices. Of these two types, known cold cathode devices include field-emission electron-emitting devices (hereinafter abbreviated to the FE type), metal/insulator/metal type electron-emitting devices (hereinafter abbreviated to the MIM type) and surface conduction electron-emitting devices.

FIG. 10 schematically shows the configuration of an example of display panel of an image displaying apparatus using conventional surface conduction electron-emitting devices.

In FIG. 10, reference numeral 103 denotes a rear plate; 104, an external frame and 110, a face plate. The rear plate 103, the external frame 104 and the face plate 110 constitute an envelope (airtight vessel) for keeping the inside of the display panel vacuum. An electron source substrate 101 is fixed to the rear plate 103, and N×M surface conduction electron-emitting devices 106 are formed over the electron source substrate 101 (N and M are positive integers not smaller than 2, whose number is appropriately set according to the intended number of display pixels). The N×M electron-emitting devices 106 are wired with M X-directional wires 102 and N Y-directional wires 105 as shown in FIG. 10. Between the X-directional wires 102 and the Y-directional wires 105, at least where they cross, an insulating layer (not shown) is formed to maintain electric insulation.

A fluorescent film 108 consisting of phosphors is formed over the under face of the face plate 110, differentiated in color by phosphors (not shown) of three primary colors including red (R), green (G) and blue (B). Black components (not shown) are provided between the phosphors of different colors constituting the fluorescent film 108, and a metal back 107 consisting of Al or the like is formed on the face of the fluorescent film 108 toward the rear plate 103.

Dx1 through Dxm, Dy1 through Dyn and a high voltage terminal Hv are airtight-structured terminals for electrical connection, provided to electrically connect the display panel to an electrical circuit (not shown). Dx1 through Dxm are electrically connected to the X-directional wires 102 of the electron source, Dy1 through Dyn to the Y-directional wires 105 of the electron source, and Hv to the metal back 107.

The inside of the envelope 111 is maintained in a vacuum of around $1.3\times10^{-4}$ Pa. As the display area of the image displaying apparatus expands, the need increases for means to prevent deformation or destruction of the rear plate 103 and the face plate 110 due to the pressure difference between the inside and the outside of the envelope 111. Increasing the thicknesses of the rear plate 103 and the face plate 110 would not only make the image displaying apparatus heavier but also give rise to image distortion and parallax when the display panel is viewed obliquely. In view of this problem, the configuration shown in FIG. 10 is provided with structural supports (known as spacers or ribs) 112 consisting of relatively thin glass plates and intended to stand the atmospheric pressure. In this way the gap between the substrate 101 on which electron source is formed and the face plate 110 on which the fluorescent film 108 is formed is usually kept between sub-millimeters to a few millimeters, and the inside of the envelope 111 is kept at a high degree of vacuum.

In an image displaying apparatus using the display panel, when voltages are applied to the electron-emitting devices 106 through extra-container terminals Dx1 through Dxm and Dy1 through Dyn, electrons are emitted from each of the electron-emitting devices 106. At the same time, a high voltage of hundreds to thousands of volts is applied to the metal back 107 via the extra-container terminal Hv to accelerate the motions of the emitted electrons and cause them to collide against the inner face of the face plate 110. The phosphors of different colors constituting the fluorescent film 108 are thereby excited to emit light and display an image.

In addition to ones of the configuration described above, there also are other displays, such as liquid crystal displays, plasma displays and EL displays, in which the internal space is defined by a frame, a face plate and a rear plate, the latter two being two members opposite each other, and a desired atmosphere is maintained in the internal space.

Examples of the prior art realizing such displays are disclosed in Patent Documents 1 and 2.

Patent Document 1: U.S. Pat. No. 5,813,893

Patent Document 2: Japanese Patent Application Laid-Open No. 11-135018

SUMMARY OF THE INVENTION

A problem intended to be solved by at least part of the invention under the present application is to realize a method of manufacturing appropriate airtight vessel.

Some of the specific problems reflected in the following preferred embodiments of the invention will be described below.

The present inventor assessed the possibility of using a member smaller in sectional size (e.g. sectional width) as the member for use in the external frame with a view to reducing the size of the screen frame (non-display area) and the cost of members. However, he found that a smaller sectional size of the frame member would result in insufficient mechanical rigidity. In other words, the frame would be unable to maintain its shape by itself. As a result, it would become difficult in assembling the panel to accurately align the external frame, which is the frame member, with desired positions in the face plate and the rear plate and assemble them. If the positional accuracy of the external frame is poor, the likelihood of impossibility to maintain a desired atmosphere in the internal space will increase, leading to a drop in yield.

According to one aspect of the invention, there is provided a method of manufacturing airtight vessel having two substrates and a frame portion fixed to the two substrates and forming a prescribed space between the two substrates, comprising a step of keeping a frame member for the frame portion in a prescribed shape by applying a tension to at least part of the frame member for the frame portion, and a step of adhering the frame member to at least one of the substrates in a state in which the prescribed shape is kept.

According to another aspect of the invention, there is provided a method of manufacturing airtight vessel having two substrates and a frame portion fixed to the two substrates and forming a prescribed space between the two substrates, comprising a step of airtightly adhering a frame member for the frame portion to the two substrates in a state in which the frame member is kept in a prescribed shape by a frame member position-restricting member.

According to still another aspect of the invention, there is provided a method of manufacturing airtight vessel having two substrates and a frame portion fixed to the two substrates and forming a prescribed space between the two substrates, comprising a step of keeping a frame member for the frame portion in a prescribed shape with a frame member position-restricting member for restricting the positions of the frame member in a state in which the frame portion is in contact with neither of the two substrates, and a step of adhering the frame member to at least one of the substrates.

The method of manufacturing airtight vessel according to the invention include the following as preferable forms:

The frame member restricting member is positioning members fixed to at least one of the substrates;

The frame member restricting members is composed of a jig for fixing the frame member to one of the substrates.

The frame member is rectangular, and its four corners are supported by frame member position-restricting members.

The frame member is rectangular, and one pair of opposite sides are more rigid than the other pair of opposite sides.

As will be disclosed in more specific terms in the following description of the embodiment of the invention, the airtight vessel under the present application can be suitably applied to an image display apparatus, and the application includes an invention of an image display apparatus and an invention of a method of manufacturing the image display apparatus. It also includes a method of manufacturing an image display apparatus each using the image displaying apparatus.

DESCRIPTION OF THE PREFERRED EMBODIMENTS

Figure 1:
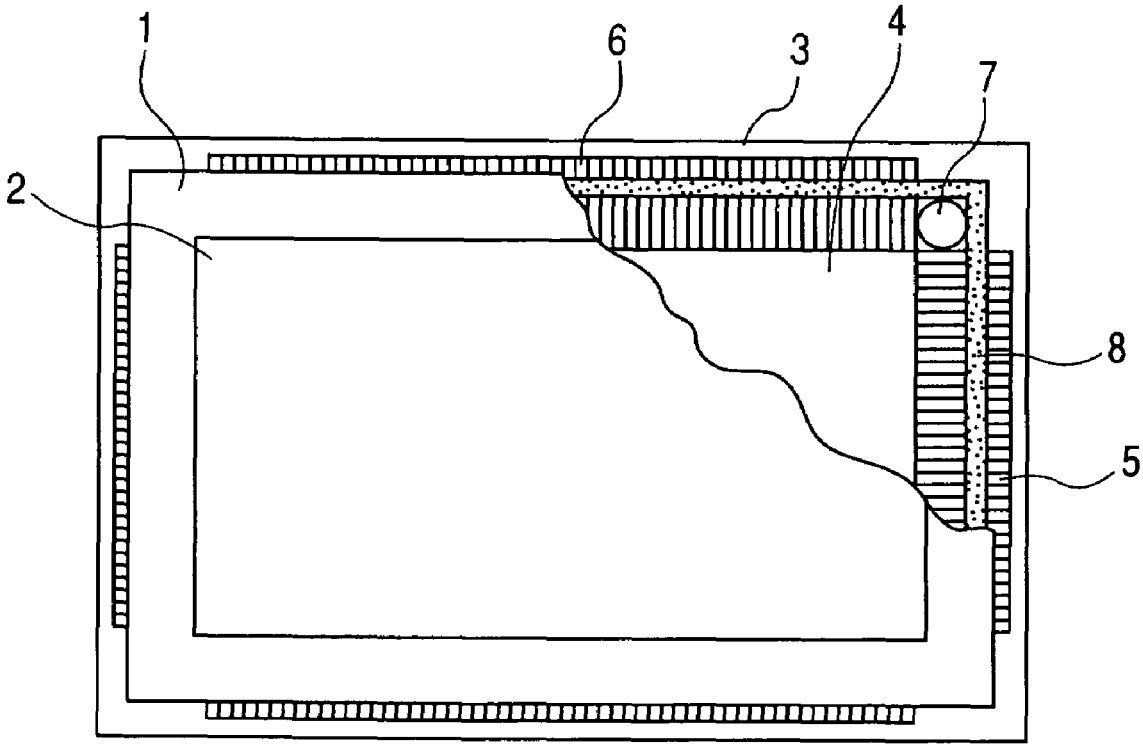
FIG. 1 is a schematic diagram showing the configuration of a display panel according to a first embodiment of the present invention.

A method of manufacturing airtight vessel described below in the embodiment of the present invention uses frame member position-restricting member in adhering and fixing a frame member to substrates, so that the frame member is adhered while its shape is maintained as it should be.

In the embodiment of the invention, the step of adhering the frame member to the substrates may be executed either by adhering the frame member, after it is adhered to one of the substrates, to the other or by having the two substrates hold the frame member between them and adhering the frame member to both substrates at the same time.

The invention will be described in detail below with reference to the display panel of an image displaying apparatus utilizing the emission of electrons as described above.

Whereas the two substrates for use in the invention may be members whose material and shape can be selected from various alternatives, usually insulating substrates, particularly glass substrates, are preferred for use in configuring a display panel. For instance, flat substrates of soda lime glass are used. Basic materials that can be used for the frame member include insulators and high resistors, but it is preferable to use the same material as that for the substrates. As the adhesive for fixing the frame member to the substrates, a preferable choice is a metal having a low melting point, more specifically In or some other metal or an alloy thereof, because it has to perform dual functions of keeping vacuum airtightness and adhesion to the glass substrates. Such an adhesive is softened by heating when it is applied. If the adhesive is electroconductive, it can be heated by applying electricity, but the application of electricity should preferably be used in combination with some other means of heating. More specifically, heating by irradiation with an electromagnetic wave, heating by thermal conduction from a heat source, or combined use of the two is preferable.

The two substrates that can be used in implementing the invention are subject to no limitation regarding the external shape of their main faces, but usually at least one of them is a planar member having an exactly or substantially rectangular (oblong or square) shape. The frame member is disposed in a shape substantially along the contours of these rectangular substrates or substantially along a shape formed by contracting this rectangle inward. The invention makes it possible to fabricate an airtight vessel by using a frame member which cannot maintain its shape by itself. The frame member in this context means a frame member whose shape cannot be maintained with required accuracy by holding only one position thereof.

In order for a rectangular frame member to maintain its rectangular shape, it is desirable to define the positions of its four corners. Therefore in a preferable embodiment of the invention, it is desirable for the position-restricting member of the frame member to support and restrict the position of the frame member on flanks inside or outside its corners. It is also preferable to support at least two of the four sides of the frame member. In a preferable configuration, the desired shape is maintained by applying a tensile strength to each position of the frame member. In order to keep the rectangular or any other polygonal shape of the frame member, the tension should work on the sides of the frame member. More specifically, the shape can be maintained in a state in which each side of the rectangle is subjected to a tensile strength by defining the positions of the four corners of the rectangular shape as mentioned above. In a preferable configuration, a tension is applied to the part between two positions of each side by defining those two positions. Preferable two such positions are the two ends of the side. Since one defining position can be shared by two adjoining sides, four such defining positions are sufficient where a rectangle is to be maintained by applying a tension to each of its four sides. It is not necessary to subject every side to a tension, but it is acceptable to use a configuration which allows the shape to be maintained even if some of the sides are subjected to no tension but tensions are applied to only those sides which without being subjected to a tension cannot contribute to keeping the shape as in the fourth embodiment to be described afterwards. Where the substrate size is greater, the supporting positions can be increased to more than four or a frame member whose section is not uniform but is expanded in area to partially strengthen the rigidity can be used. In this case, either the frame member can be fabricated from the outset with its sectional area partially varied, or another member can be adhered to the part where the sectional area is to be expanded.

As the position-restricting members for the frame member, either positioning members into which the frame member is fitted after it is fixed to one of the substrates and which support the fitted frame member or a jig which is fitted to the frame member and fixes the frame member to the substrates is used. The jig can be removed after the step of adhering and fixing the frame member to the substrates. In that case, part of the jig can be cut off and removed, and the rest may remain with the frame member. It is preferable for the basic material for the positioning members, if they are to be fixed onto the substrates, to be a material close to that of the substrates in thermal expansion coefficient, or more preferably the same as the material of the substrates, with a view to harmonizing their thermal expansion with those of the substrates. Therefore, where the substrates are made of glass, preferably the positioning members should also be made of glass. Regarding the jig, since its shape is complex, desirably it should be made of a material which readily allows machining and is close to the substrate material in thermal expansion coefficient. Where the substrates are made of glass, the preferable material is an Ne—Ni alloy.

The method of manufacturing according to the invention will be described below in more specific terms with reference to the embodiments, but the invention is not limited to these embodiments.

First Embodiment

Figure 2A:
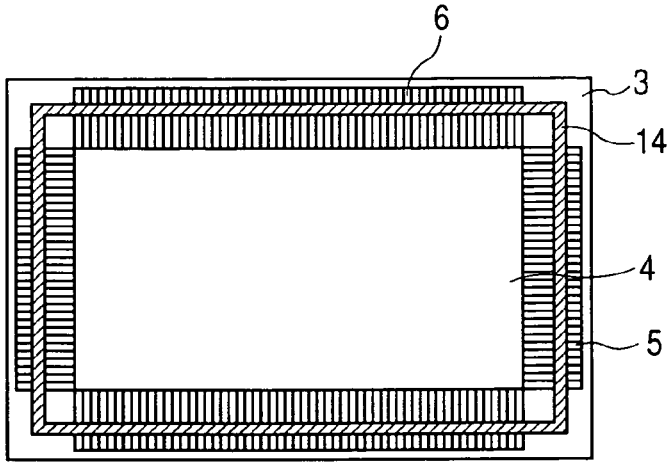
FIGS. 2A, 2B and 2C are schematic diagrams showing the manufacturing process of the display panel according to the first embodiment of the invention.

The first embodiment of the invention will now be described with reference to FIG. 1 through FIGS. 4A and 4B. In the figures, reference numeral 1 denotes a face plate; 2, an image display area; 3, a rear plate; 4, an electron source area; 5 and 6, extraction wirings; 7, positioning members; 8, a frame member; 11, an adhesion layer; 12*a* and 12*b*, low melting-point metal layers; 13*a* through 13*c*, base layers; and 14, an insulating layer. FIG. 4B shows the A-A' section of FIG. 4A. Incidentally, the illustration of the insulating layer 14, the base layers 13*a*, 13*b* and 13*c*, and the low melting-point metal layer 12*a* is dispensed with in FIG. 4A.

Figure 10:
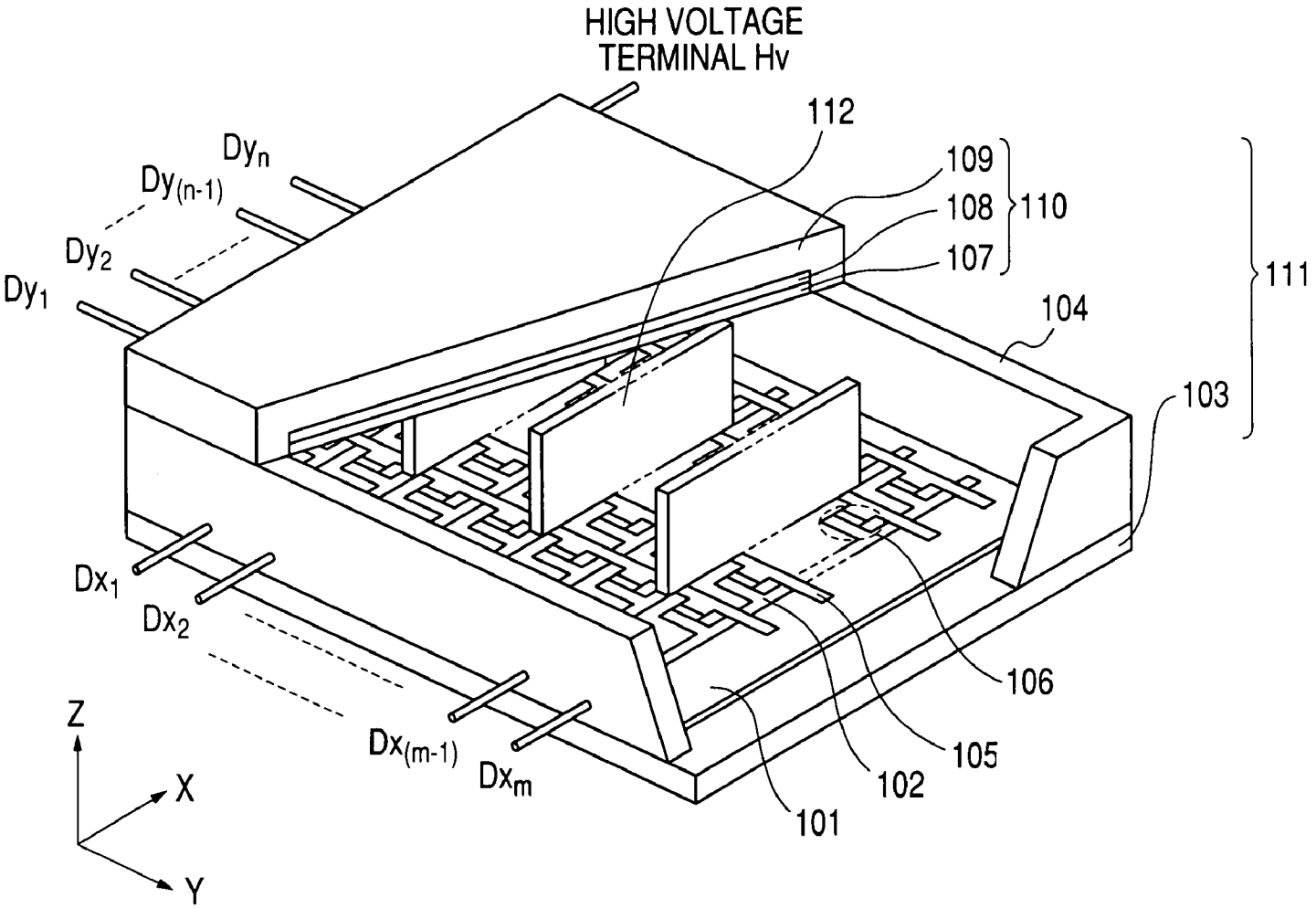
FIG. 10 schematically shows the configuration of an example of display panel of an image displaying apparatus using conventional surface conduction electron-emitting devices.

In this embodiment, the face plate 1, the rear plate 3 and the frame member respectively correspond to the face plate 110, the rear plate 103 and the external frame 104 of the display panel in FIG. 10.

The image display area 2 of the face plate 1 consists of a fluorescent film (not shown), black stripes (or a black matrix) and a metal back. When the fluorescent film is monochrome, it can be configured of a phosphor alone, and when it is in color, it can be composed of black conductors known as black stripes or a black matrix and phosphors according to the array of the phosphors. The reasons for the use of the black stripes or black matrix are to make, in color displaying, any mixing of colors inconspicuous by blackening the boundaries between the phosphors of the three primary colors and to restrain any loss of contrast due to the reflection of external light by the fluorescent film. The black stripes are usually made of a material mainly consisting of graphite, but some other electroconductive material transmitting or reflecting less light can also be used.

The fluorescent film can be formed by coating the image display area 2 with phosphors, irrespective of monochrome or color, by depositing, printing or otherwise. A metal back is usually provided on the inner side of the fluorescent film. The purposes of providing the metal back include improvement of luminance by bringing the inward part of the light emission from the phosphors to mirror reflection toward the face plate 1, causing it to serve as an electrode for applying an electron beam accelerating voltage, protection of the phosphors from being damaged by the collision of negative ions generated within the envelope. The metal back can be fabricated by smoothing the inner surface of the fluorescent film (usually referred to as "filming") after the formation of the fluorescent film and depositing Al by vacuum evaporation or otherwise.

The electron source area 4 is configured by arraying surface conduction electron-emitting devices (not shown), which are display devices, over the rear plate 3 in a matrix form as described in the Japanese Patent Application Laid-Open No. H7-235255, and the extraction wirings 5 and 6 are connected to the X-direction wiring (not shown) and the Y-direction wiring (not shown) and extracted to the end of the rear plate 3. The extraction wirings 5 and 6 can be formed over the rear plate 3 by patterning an Al paste material by a known printing method and subjecting them to a baking process. Then, the glass component is shaped into a frame by a known printing method and baked to form the (FIG. 2A). Although this embodiment is described with reference to a display apparatus using electronic beams by way of example, if the invention under the present application is to be applied to a plasma display, the display devices will be configured of electrodes for causing a discharge to take place.

An Ag paste is patterned by a known printing method over the insulating layer 14 shaped in a frame, and baked to constitute the base layer 13*a*. To insulate them from the extraction wirings 5 and 6, the base layer 13*a* is formed to be slight smaller in width than he insulating layer 14.

Figure 2B:
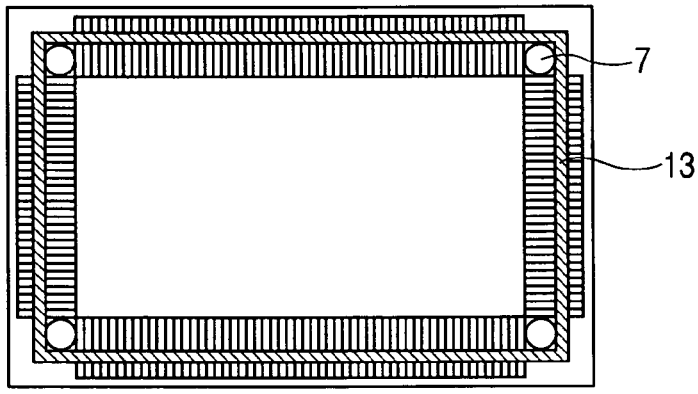
Figure 3:
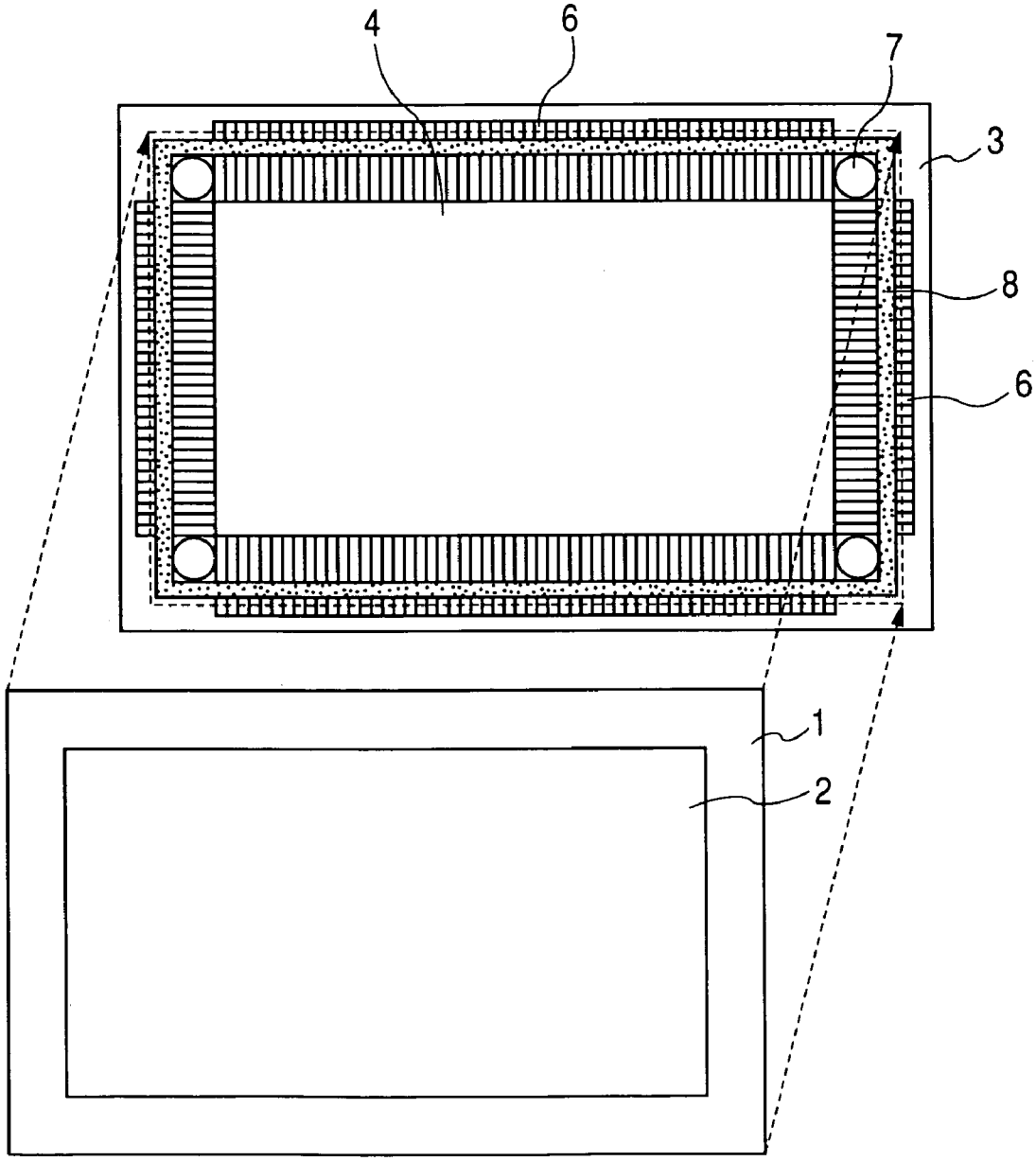
FIG. 3 is a schematic diagram showing the step of adhering a face plate in the first embodiment of the invention.

Then, the ceramic-made cylindrical positioning members 7 are adhered and fixed in the four corners, the positions where the frame member 8 is to be adhered, with the ceramic adhesion layer 11 (FIG. 2B). The positions of adhesion are adjusted to be appropriate (within the permissible range of the positional deviation of the frame member 8) with the inner dimensions of the frame member 8 and the external shape of the positioning members 7 taken into account. The heights of the positioning members 7 are kept lower than that of the frame member 8.

A low melting-point metal is applied over the base layer 13*a* with a coating robot and an ultrasonic soldering iron to form the low melting-point metal layer 12*a*. On the other hand, the glass substrates are machined to form the frame member 8, and an Ag paste material is patterned by a known printing method and baked to constitute the base layer 13*b*. The frame member can also be punched out of a glass plate, or formed by welding glass rods constituting the four sides of the rectangular frame. The material of the frame member is not limited to glass, but the frame can as well be fabricated by shaping a thin rod, such as a wire, into a loop.

Figure 2C:
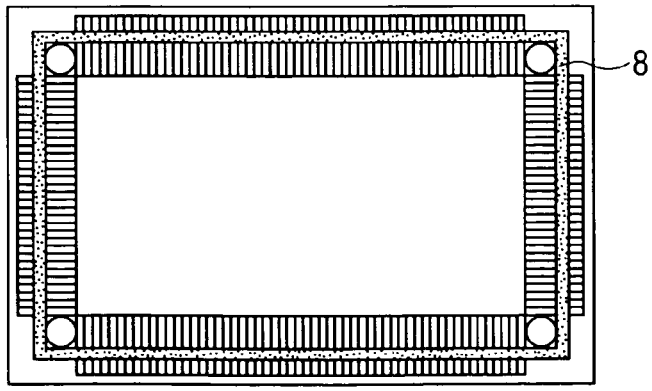

The frame member 8, with its base layer 13*b* directed toward the rear plate 3 is positioned over the four positioning members 7 with a robot hand (not shown) which can keep it horizontal and provide a tension outward from each of the four corners of the frame member 8, and cautiously landed over the rear plate 3. The rectangular shape of the frame member 8 can be thereby kept in a state in which a tension is applied to each of its sides from one or another of the positioning members 7 (FIG. 2C).

Figure 4A:
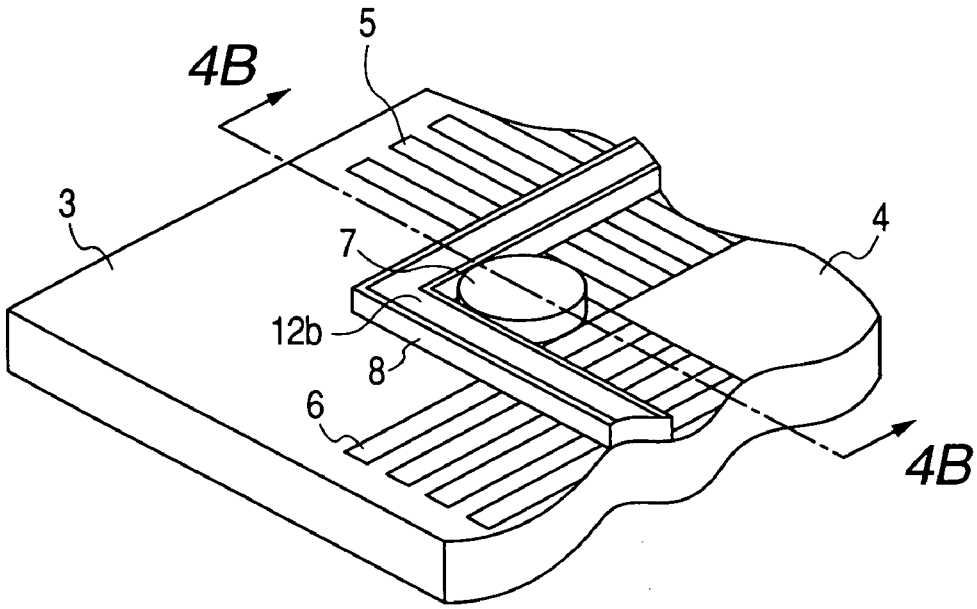
FIGS. 4A and 4B are schematic diagrams showing a state in which a frame member is adhered to a rear plate in the first embodiment of the invention.
Figure 4B:
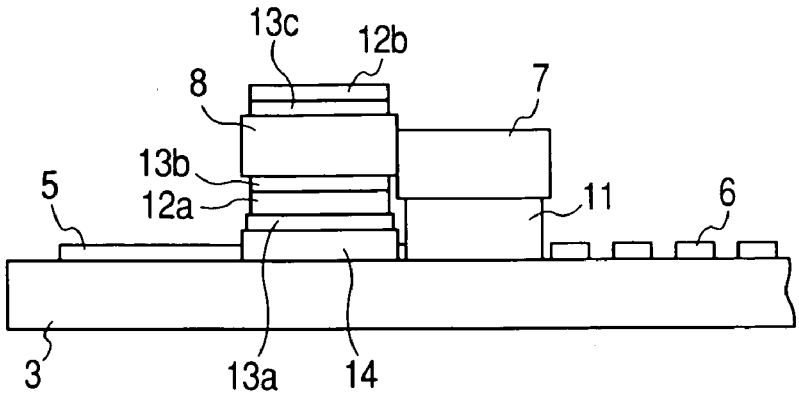

Over the frame member 8, the base layer 13*c* is formed, followed by the low melting-point metal layer 12*b*, by the same processes as those for the base layers 13*a* and 13*b* and the low melting-point metal layer 12*a* (FIGS. 4A and 4B).

The face plate 1 and the rear plate 3 are placed into a vacuum chamber (not shown) in which the substrates can be heated, aligned (X, Y) and subjected to spacing control. Within the vacuum chamber, the face plate 1 and the rear plate 3 are aligned with each other according to alignment marks (not shown) formed on those plates (FIG. 3). In this process, there is a gap between the face plate 1 and the rear plate 3, which accordingly are not in contact with each other. In this state, the temperatures of the face plate 1 and the rear plate 3 are raised with a substrate heating apparatus to the melting points of the low melting-point metal layers 12*a* and 12*b*. Then, the face plate 1 and the rear plate 3 are brought close to each with a spacing control apparatus to cause the low melting-point metal layer 12*b* and the face plate are joined to each other, and so are the low melting-point metal layer 12*a* and the base layers 13*a* and 13*b* sandwiching it. This process should be carried out cautiously so that the low melting-point metal may not ooze out on the four sides of the frame member 8. By lowering the temperatures of the substrates after that, the face plate 1 and the rear plate 3 are adhered to the frame member 8 to constitute an airtight vessel. As the frame member 8 then is subjected to positional restriction by the positioning members 7, it can substantially maintain its initial position free from major positional deviations, and constitute a highly airtight vessel. Therefore, a highly reliable display panel can be provided for an image displaying apparatus in which images are formed by emitting electrons in a vacuum ambience.

By taking out the vessel from the vacuum chamber into the atmosphere after that, the inside of the vessel surrounded by the face plate 1, the rear plate 3 and the frame member 8, keeping a vacuum state, is completed as a vacuum airtight vessel.

The materials and formation methods for the extraction wirings 5 and 6, the adhesion layer 11 and the insulating layer 14 and the material of the positioning member 7 are not limited to those stated above.

Figure 11:
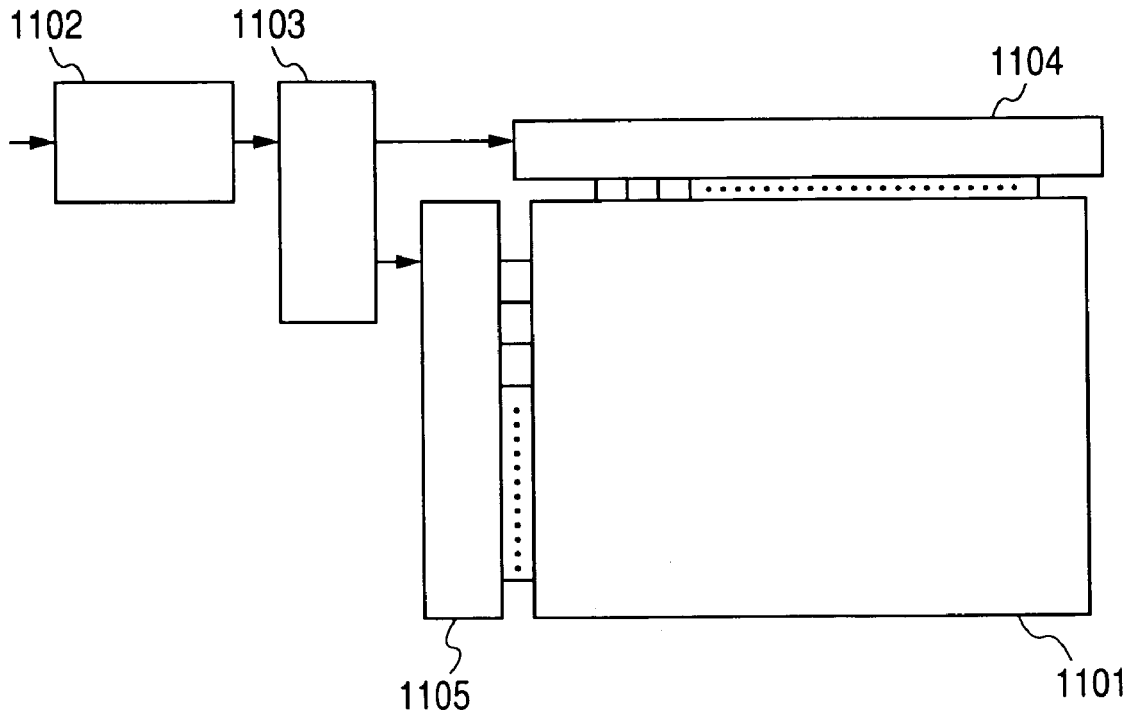
FIG. 11 shows the configuration of a television set.

When a television set is to be fabricated by using the image displaying apparatus fabricated as described above, a tuner is connected to this image displaying apparatus. The resultant configuration is shown in FIG. 11. A display panel 1101 has the airtight vessel configured as described above. A receiver circuit 1102 having the tuner selects television broadcast signals of a desired channel. Signals from the receiver circuit 1102 are entered into a control circuit 1103, where column drive signals and line drive signals are generated and supplied to a column drive signal and a row drive signal, and supplied to a column drive circuit 1104 and a row drive circuit 1105. The column drive signal is a modulating signal. The row drive signal is a scanning signal for sequentially selecting display lines on the display panel. A drive pulse based on the column drive signal is supplied by the column drive circuit 1104 to the display panel 1101. A drive pulse based on the row drive signal is supplied by the row drive circuit 1105 to the display panel 1101. Where this television set is to be fabricated by using the display apparatus described above, the column drive circuit 1104 is connected to the display panel 1101 by using a flexible cable. The row drive circuit 1105 is also connected by using a flexible cable. Then, the control circuit 1103 is connected to the column drive circuit 1104 and the row drive circuit 1105, followed by connection of the receiver circuit 1102 and the control circuit. The television set can be fabricated in this way.

Second Embodiment

Figure 5:
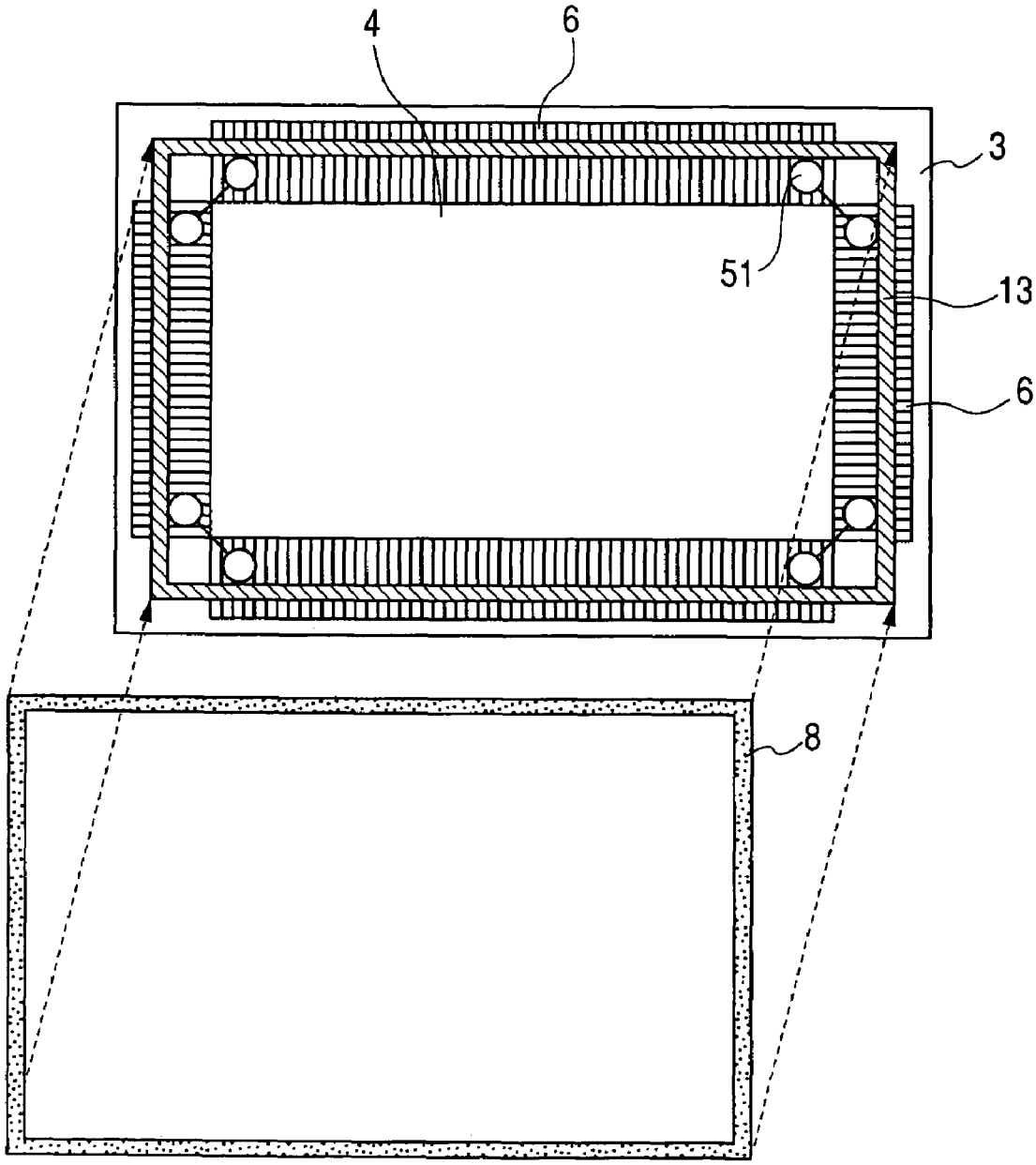
FIG. 5 is a schematic diagram showing how the frame member and the rear plate are aligned with each other in a second embodiment of the invention.

FIG. 5 shows how the frame member 8 and the rear plate 3 are aligned with each other in a second embodiment of the invention. In FIG. 5, reference numeral 51 denotes positioning members, and the same members as in FIG. 3 are denoted by respectively the same reference signs.

Each of the positioning members 51 consists of two ceramic-made cylindrical members linked to each other, but the two members may as well be separated from each other. The positioning members 51 are positioned in the four corners, each along two sides constituting one corner of the frame member 8, to perform positional restriction.

This embodiment is more effective than the first embodiment for a display panel required to have a large screen because a large frame member 8 can be more securely subjected to positional restriction in this way.

Third Embodiment

Figure 6:
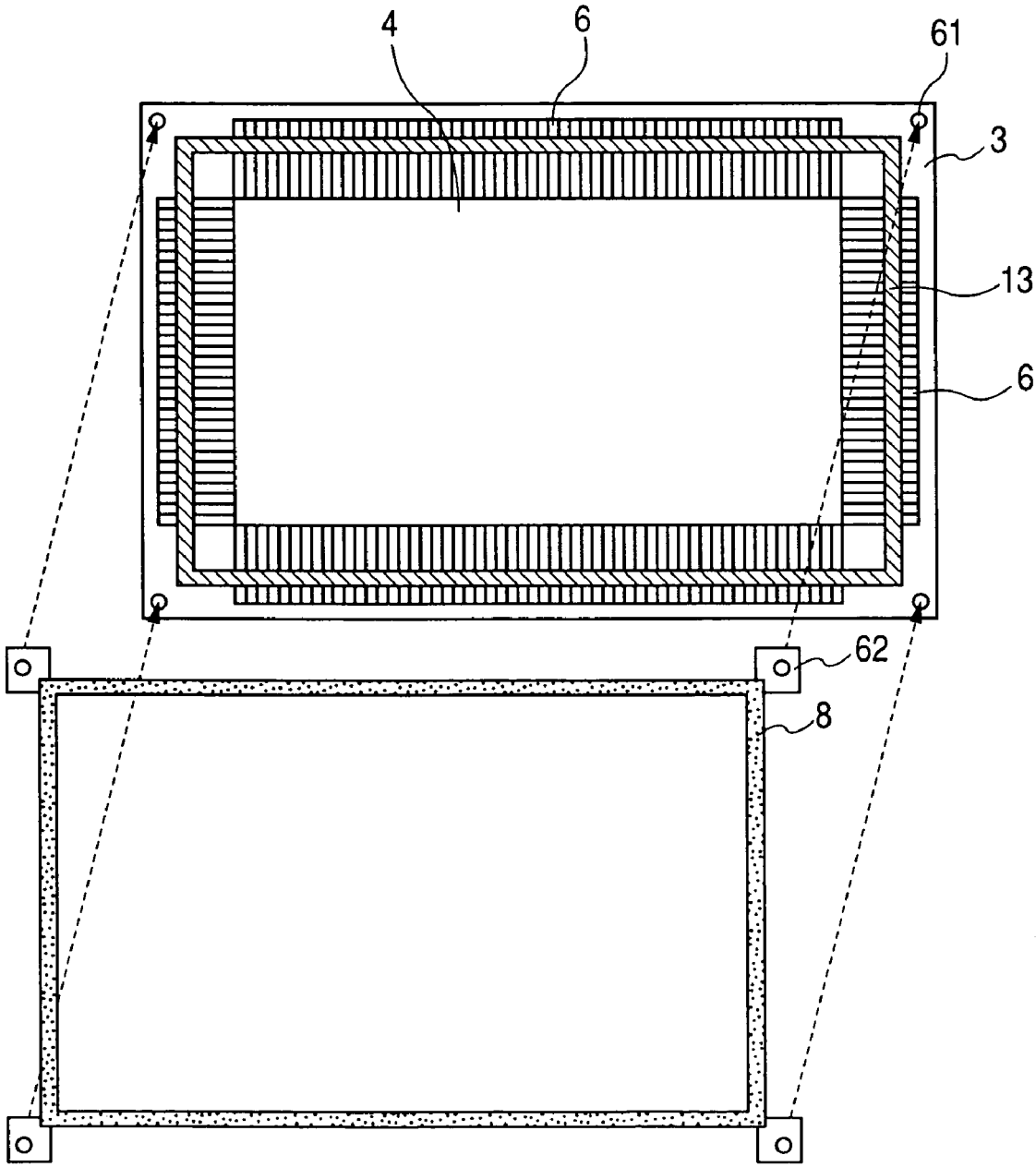
FIG. 6 is a schematic diagram showing how the frame member and the rear plate are aligned with each other in a third embodiment of the invention.

FIG. 6 shows how the frame member 8 and the rear plate 3 are aligned with each other in a third embodiment of the invention. In FIG. 6, reference numeral 61 denotes positioning pins, and, 62, fixing members. The same members as in FIG. 3 are denoted by respectively the same reference signs.

This embodiment is the same as the first embodiment except that the positioning pins 61 and the fixing members 62 are used as positioning members and that the frame member 8 is subjected to positional restriction outside it. More specifically, holes bored in the fixing members 62 fitted outside the four corners of the frame member 8 are snapped with a robot hand (not shown) onto the positioning pins 61 fitted to the corners of the rear plate 3. The positioning pins 61 and the fixing members 62 should preferably be formed of ceramics.

This embodiment, since the positioning members are fitted outside the frame member 8, requires care about degassing only when fabricating the vacuum vessel, because neither the adhesive used for fitting the fixing members 62 to the frame member nor that for fitting the positioning pins 61 to the rear plate affects degassing in the vessel. There is no requirement for long-lasting degassing stability, which means an expanded choice of adhesives and the applicability of general-purpose adhesives.

Fourth Embodiment

Figure 7:
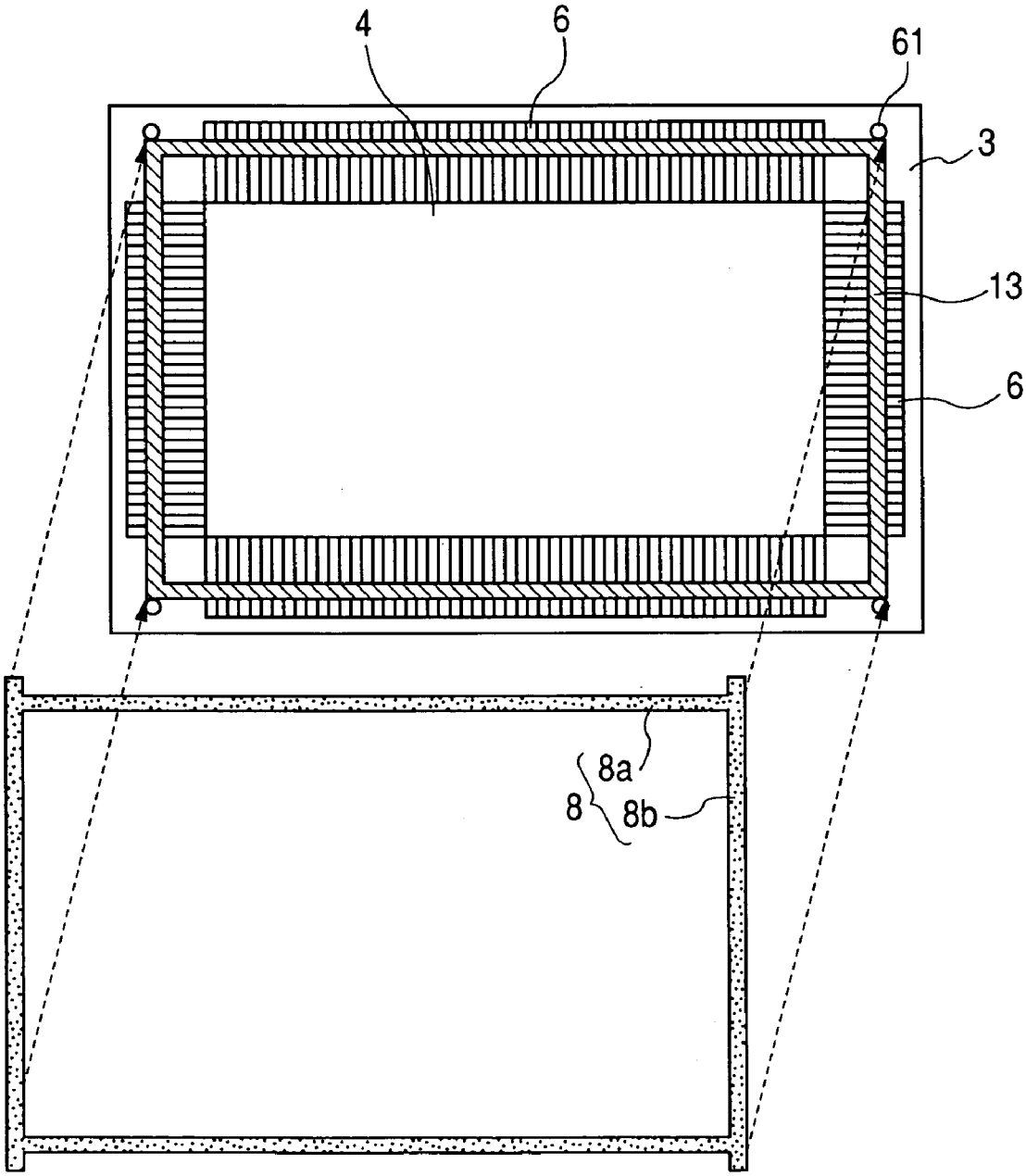
FIG. 7 is a schematic diagram showing how the frame member and the rear plate are aligned with each other in a fourth embodiment of the invention.

FIG. 7 shows how the frame member 8 and the rear plate 3 are aligned with each other in a fourth embodiment of the invention. The reference signs in FIG. 7 are the same as those in FIG. 6.

This embodiment is the same as the first embodiment except that the frame member 8 is ladder-shaped, one pair of opposite sides 8*b*, made more rigid than the other pair of opposite sides 8*a*, the positioning pins 61 are used as positioning members, and the frame member 8 is subjected to positional restriction by them outside it.

In this embodiment, both ends of the sides 8*b* of the frame member 8 are supported by the positioning pins 61 and tensions work on the sides 8*a* to pull them in the lengthwise direction, but the more rigid sides 8*b* can well endure those tensions. As the number of parts is smaller than in the third embodiment, the production cost can be reduced. Thus, when the shape of a rod is to be kept rectangular or in any other polygonal shape by applying tensions, it is not necessary to apply tensions to all the sides as in the first embodiment, but it is sufficient to apply tensions only to those sides whose shape cannot be maintained unless subjected to tension.

Fifth Embodiment

Figure 8:
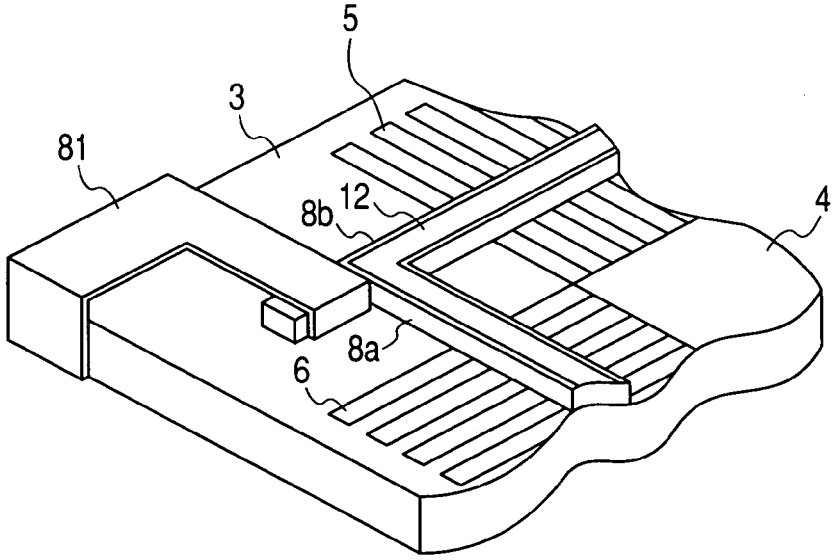
FIG. 8 is a schematic diagram showing how the frame member is supported by frame member position-restricting members in a fifth embodiment of the invention.

FIG. 8 shows how the frame member 8 is supported by the frame member position-restricting members in a fifth embodiment of the invention. In FIG. 8, reference numeral 81 denotes a jig, and the same members as in FIG. 4 and FIG. 7 are denoted by respectively the same reference signs.

This embodiment is the same as the first embodiment except that a jig 81 constitutes the frame member position-restricting members and the frame member 8 is ladder-shaped, consisting of more rigid elements 8*b* and less rigid elements 8*a*.

In this embodiment, the material of the jig 81 is matched with that of the rear plate 1 in consideration of thermal expansion arising during the assembling of the panel, and the jig 81 is caused to hold a more rigid member 8*b* to fix it to the rear plate 1. After the panel is assembled, the jig 81 can be removed.

In this embodiment, since no positioning pins 61 are required unlike in the fourth embodiment, the manufacturing cost can be reduced.

Sixth Embodiment

Figure 9:
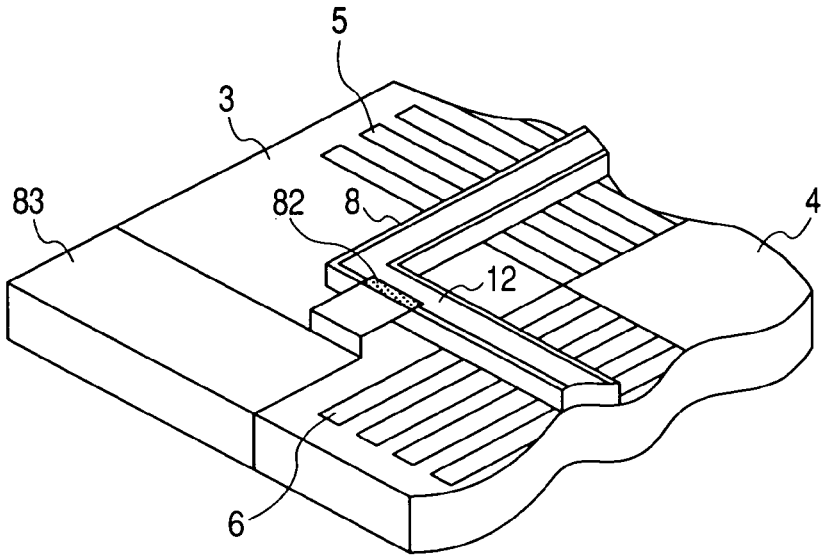
FIG. 9 is a schematic diagram showing how the frame member is supported by the frame member position-restricting members in a sixth embodiment of the invention.

FIG. 9 shows how the frame member 8 is supported by the frame member position-restricting members in another embodiment of the invention. In FIG. 9, reference numeral 82 denotes the adhering portion of a jig, 83, the jig, and the same members as in FIGS. 4A and 4B are denoted by respectively the same reference signs.

This embodiment is the same as the first embodiment except that the jig 83 constitutes the frame member position-restricting members, a low melting-point metal and a soldering iron are used to form the adhering portion 82, and the jig 83 is directly adhered and fixed to the frame member 8. The jig 83 is so structured as can be hooked on to an angular part of the rear plate 3.

In this embodiment, since the frame member 9, while it is being handled, can be carried by picking up the jig 83, the design freedom of the carrying apparatus can be enhanced. After the panel is assembled, with the jig 83 left as it is, a panel driving box grounding (not shown) and the adhering portion 82 can be connected to allow the jig to be used as a member to define the potential. Or it can as well be cut off in a desired position.

In the first through sixth embodiments described above, the number, sizes and intra-facial positions of the frame member position-restricting members can be freely selected within the scope of the invention, and the substrate to which the frame member is adhered first can as well be used as the face plate 1.

EXAMPLES

Example 1

A display panel for an image displaying apparatus was fabricated in the first example.

For this example, a face plate 1 having a fluorescent film and a metal back formed over soda lime glass substrates and a rear plate 3 consisting of surface conduction electron-emitting devices, disclosed in the Japanese Patent Application Laid-Open No. H7-235255, arranged in a matrix formed over the soda lime glass substrates was used. For its frame member 8, similar glass material to those of the face plate 1 and the rear plate 3 was used. An In material as used for its low melting-point metals 12*a* and 12*b*, an Ag paste (wiring material), for its base layers 13*a* through 13*c*, and cylindrical members of 3 mm in diameter and 1 mm in thickness, mainly made of a ceramic which does not contaminate the vacuum ambience, was used for the position-restricting members 7.

When the display panel thereby obtained was connected to a driving electrical system and its displaying function was tested, it was confirmed that the vacuum within the panel was kept satisfactory, and that the panel could be driven stably and display images appropriately.

Example 2

A display panel for an image displaying apparatus was fabricated in the same way as Example 1 except that two ceramic-made cylindrical members of 8 mm in diameter and 1 mm in thickness, linked to each other by a low-thermal expansion metal rod, were used as the position-restricting members 51 in the second example.

When the display panel thereby obtained was connected to a driving electrical system and its displaying function was tested, it was confirmed that the vacuum within the panel was kept satisfactory, and that the panel could be driven stably and display images appropriately.

This application claims priority from Japanese Patent Application Nos. 2004-012993 filed Jan. 21, 2004 and 2004-362525 filed Dec. 15, 2004, which are hereby incorporated by reference herein.

What is claimed is:

1. A method of manufacturing an airtight vessel having two substrates and a frame portion fixed to the two substrates and forming a prescribed space between the two substrates, comprising:

a step of keeping a frame member of closed shape for forming said frame portion in a polygonal shape by applying a tension to the frame member;

a step of adhering said frame member to one of the substrates in a state in which said polygonal shape is kept; and a step of adhering another of the substrates to said frame member adhered to the one of the substrates, wherein the tension is applied in a longitudinal direction of each side of the polygonal shape.

2. The method of manufacturing an airtight vessel according to claim 1, wherein the applying of said tension is accomplished by a frame member position-restricting member which restricts a corner portion of the polygonal shape of said frame member.

3. The method of manufacturing an airtight vessel according to claim 2, wherein said frame member position-restricting member is a positioning member fixed to at least one of the substrates.

4. The method of manufacturing an airtight vessel according to claim 2, wherein said frame member-restricting member is composed of a jig for fixing said frame member to one of the substrates.

5. The method of manufacturing an airtight vessel according to claim 1, wherein said frame member and at least one of said substrates are airtightly adhered at said adhering step.

6. The method of manufacturing an airtight vessel according to claim 1, wherein said polygonal shape is rectangular shape.

7. A method of manufacturing an image displaying apparatus having two substrates, a frame portion fixed to the two substrates and forming a prescribed space between the two substrates, and display devices arranged in said space, comprising:

a step of keeping a frame member of closed shape for forming said frame portion in a polygonal shape by applying a tension to the frame member;

a step of adhering said frame member to one of the substrates in a state in which said polygonal shape is kept; and a step of adhering another of the substrates to said frame member adhered to the one of the substrates, wherein the tension is applied in a longitudinal direction of each side of the polygonal shape.

8. A method of manufacturing an image displaying apparatus having two substrates, a frame portion fixed to the two substrates and forming a prescribed space between the two substrates, and display devices arranged in said space, comprising:

a step of keeping a frame member of closed shape for forming said frame portion in a polygonal shape by applying a tension to the frame member, and a step of adhering said frame member to at least one of the substrates in a state in which said polygonal shape is kept, wherein the tension is applied only to certain one or more vertices of the frame member, and wherein the step of keeping the frame member is performed before the step of adhering the frame member.

* * * * *